United States Patent [19]

Jakob et al.

[11] 4,075,710

[45] Feb. 21, 1978

[54] APPARATUS FOR PRODUCING HOT MIX ASPHALT UTILIZING RECYCLABLE ASPHALT AGGREGATE

[75] Inventors: Herbert E. Jakob, Taylors, S.C.; David L. Garbelman, Edmond, Okla.

[73] Assignee: CMI Corporation, Oklahoma City, Okla.

[21] Appl. No.: 775,388

[22] Filed: Mar. 7, 1977

[51] Int. Cl.[2] ..... B28C 1/22; B28C 5/06

[52] U.S. Cl. ..... 366/25; 366/35; 366/38; 366/233

[58] Field of Search ..... 259/157, 158, 3, 156, 259/155, 159 R, 159 A, 14, 30, 81 R

[56] References Cited

U.S. PATENT DOCUMENTS

| | | | |
|---|---|---|---|
| 2,305,938 | 12/1942 | Turnbull | 259/158 |
| 2,421,345 | 5/1947 | McConnaughay | 259/158 |
| 2,487,887 | 11/1949 | McEachran | 259/158 |
| 3,693,945 | 9/1972 | Brock | 259/158 |
| 3,832,201 | 8/1974 | Shearer | 259/158 |
| 3,866,888 | 2/1975 | Dydzyk | 259/158 |

*Primary Examiner*—Robert W. Jenkins
*Attorney, Agent, or Firm*—Dunlap, Codding & McCarthy

[57] ABSTRACT

Apparatus for producing hot mix asphalt utilizing new aggregate and a previously manufactured and layed asphalt mix which has been reduced to form recyclable aggregate, comprising a cylindrical mixer drum supported for rotation about its longitudinal axis, a burner assembly for producing a flame in the drum extending from a first end of the drum to a medial portion thereof, a conveyor assembly extending from a second end of the drum to a medial portion thereof for feeding the recyclable aggregate into a medial portion of the drum, means for feeding the new aggregate into the first end of the drum and for injecting asphaltic oil into the drum, the drum being provided with a plurality of mixing flights for mixing the asphaltic oil, new aggregate and recyclable aggregate for discharge as a hot mix asphalt from the second end of the drum.

9 Claims, 2 Drawing Figures

APPARATUS FOR PRODUCING HOT MIX ASPHALT UTILIZING RECYCLABLE ASPHALT AGGREGATE

BACKGROUND OF THE INVENTION

1. Field of the Invention

This invention relates generally to improvements in apparatus for producing hot mix asphalt and, more particularly, but not by way of limitation, to an apparatus for producing hot mix asphalt utilizing new aggregate and a previously manufactured and layed asphalt mix which has been reduced to form recyclable aggregate.

2. Description of the Prior Art

As can be seen from U.S. Pat. No. 470,159, issued to Warren, and U.S. Pat. No. 616,014, issued to Robbins, it has been proposed for over eighty years to recycle old asphalt paving materials for reuse in the production of new road surfaces. As early as 1912, it was recognized in U.S. Pat. No. 1,041,226, issued to Ames, that apparatus capable of recycling old asphalt mixes are particularly advantageous if they are easily transportable between working locations. However, it was not until the development of the modern turbulent mass mixing plant of the type shown in U.S. Pat. No. 2,421,345, issued to McConnaughay, that a satisfactory portable mixing plant was devised. Unfortunately, the utilization of recyclable aggregate in mixing plants constructed to apply the McConnaughay principle, as in U.S. Pat. No. 2,487,887, issued to McEachran, proved to be generally unsatisfactory due to the tendency of such apparatus to produce huge quantities of noxious blue smoke as a result of subjecting the recyclable aggregate to excessive temperatures. Primarily as a result of this disadvantage, additional generally unsatisfactory methods have been proposed for limiting the temperature of the recyclable aggregate, such as the complicated structure shown in U.S. Pat. No. 3,845,941, issued to Mendenhall.

SUMMARY OF THE INVENTION

An apparatus for producing hot mix asphalt utilizing new aggregate and a previously manufactured and layed asphalt mix which has been reduced to form recyclable aggregate, the apparatus comprising a cylindrical mixer drum supported for rotation about its longitudinal axis, a burner assembly for producing a flame in the drum extending from a first end of the drum to a medial portion thereof, a conveyor assembly extending from a second end of the drum to a medial portion thereof for feeding the recyclable aggregate into a medial portion of the drum, means for feeding the new aggregate into the first end of the drum and for injecting asphaltic oil into the drum, the drum being provided with a plurality of mixing flights for mixing the asphaltic oil, new aggregate and recyclable aggregate for discharge as a hot mix asphalt from the second end of the drum.

It is the primary object of the present invention to provide an apparatus for producing hot mix asphalt utilizing new aggregate and a previously manufactured and layed asphalt mix which has been reduced to form recyclable aggregate.

Another object of the present invention is to provide an apparatus for producing hot mix asphalt wherein a conveyor assembly extending from one end of a cylindrical mixer drum feeds recyclable aggregate into a medial portion of the drum out of direct contact with a flame produced by a burner assembly at the opposite end of the drum, with new aggregate and asphaltic oil being introduced into the drum for mixing with the recyclable aggregate to form the hot mix asphalt.

Yet another object of the present invention is to provide an apparatus for effectively and efficiently producing hot mix asphalt utilizing new aggregate and a recyclable aggregate without appreciably polluting the environment.

Still another object of the present invention is to provide a simple and economical apparatus for producing hot mix asphalt utilizing new aggregate and a recyclable aggregate.

Other objects and advantages of the present invention will be evident from the following detailed description when read in conjunction with the accompanying drawings which illustrate the preferred embodiment of the present invention.

DESCRIPTION OF THE PREFERRED EMBODIMENT

Figure 1:
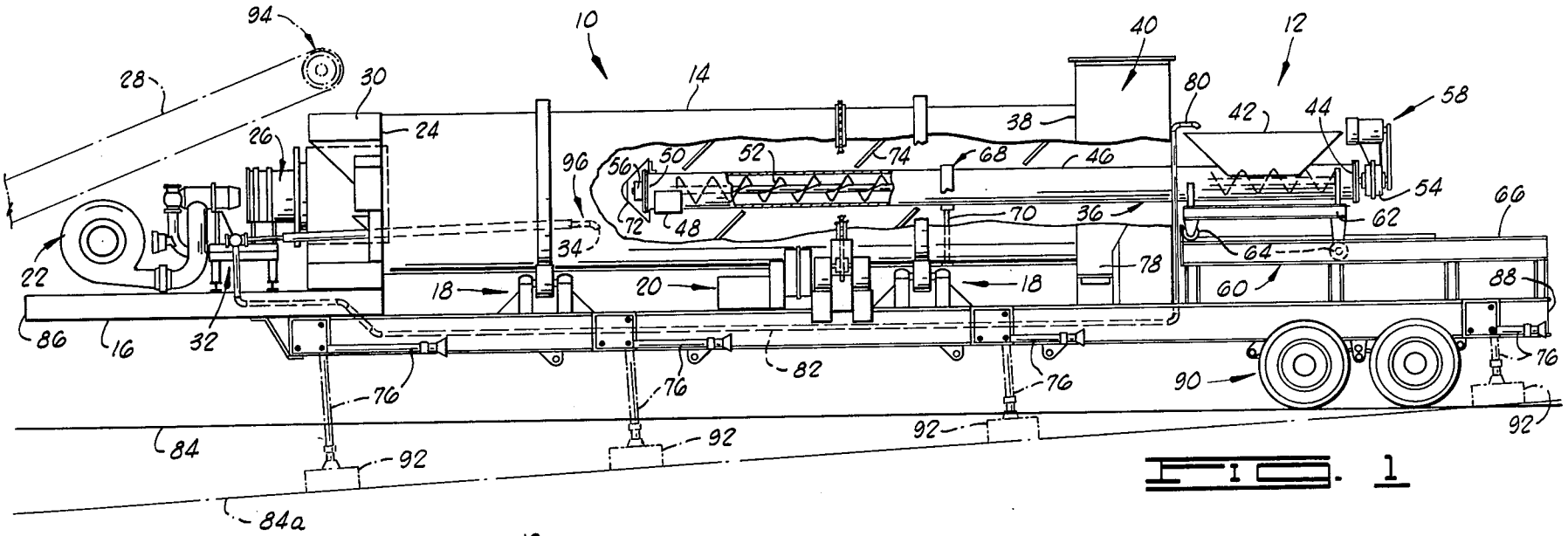
FIG. 1 is a partial cut-away, side elevational view of an asphalt mixing apparatus constructed in accordance with the preferred embodiment of the present invention.
Figure 2:
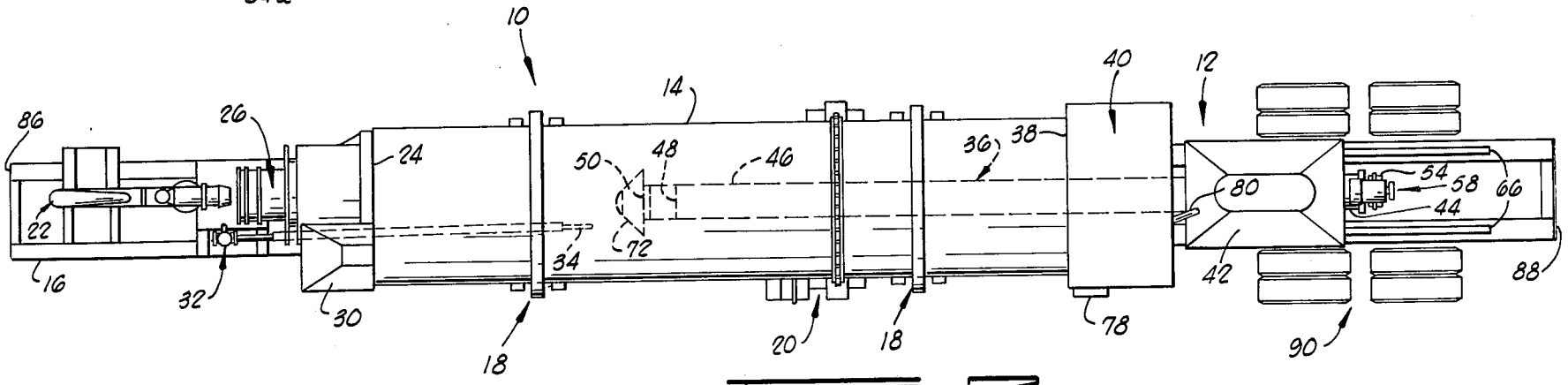
FIG. 2 is a top plan view of the mixer apparatus shown in FIG. 1, with a portion of the present invention shown in phantom.

Referring to the drawings in general, and to FIG. 1 in particular, shown therein and referred to by the general reference number 10 is an asphalt mixing apparatus constructed in accordance with the preferred embodiment of the present invention. More particularly, the mixer 10 is designed to produce standard hot mix asphalt utilizing new aggregate and a previously manufactured and layed asphalt mix which has been reduced in some conventional manner to form recyclable aggregate. The mixer 10 is constructed substantially the same as a conventional tubulent mass mixer, such as that manufactured by the Assignee of the present Application, except that the mixer 10 is provided with a recyclable aggregate conveyor assembly 12 for feeding the recyclable aggregate into a medial portion of the mixer 10 at which the temperature is sufficiently low to preclude combustion of significant quantities of the asphaltic composition of the recyclable aggregate.

The mixer 10 has a cylindrical mixer drum 14 which is supported on a wheeled frame 16 by a plurality of bearing assemblies 18 for rotation about the longitudinal axis of the mixer drum 14 via a chain drive assembly 20. A burner assembly 22 of conventional design is mounted on the frame 16 adjacent to a first end 24 of the mixer drum 14, with the flame produced by the burner assembly 22 being introduced into the first end 24 of the mixer drum 14 via a pre-ignition and combustion chamber 26. A new aggregate conveyor assembly 28 (shown in pahantom in FIG. 1) of conventional construction is preferably provided for feeding new aggregate into the first end 24 of the mixer drum 14 via a charging hopper 30 mounted on the frame 16 adjacent the first end 24 of the mixer drum 14. An asphalt injection apparatus 32 is also mounted on the frame 16 adjacent the first end 24 of the mixer drum 14, with a primary injection nozzle 34 extending through the first end 24 of the mixer drum 14 to a medial portion of the drum 14, so that heated asphaltic oil supplied from a suitable reservoir (not shown) may be introduced into the mixer drum 14 at a point at which the temperature is sufficiently low to preclude combustion of significant quantities of the oil.

The recyclable aggregate conveyor assembly 12 is comprised primarily of a screw conveyor 36 extending through a second end 38 of the mixer drum 14 to a medial portion of the mixer drum 14 via a suitably sealed opening in an outlet shroud assembly 40 mounted on the frame adjacent to the second end 38 of the drum 14.

More particularly, the screw conveyor 36 has a charging hopper 42 providing access to a first end 44 of a cylindrical screw housing 46; a discharge outlet 48 formed in the vertically lower portion of a second end 50 of the screw housing 46; and a screw 52 extending coaxially through the screw housing 46 between a first bearing 54 connected to the first end 44 of the screw housing 46 and a second bearing 56 connected to the second end 50 of the screw housing 46. The screw 52 is preferably rotated about the longitudinal axis thereof by a screw drive assembly 58 connected thereto adjacent the first end 44 of the screw housing 46.

Preferably, the screw conveyor 36 is disposed coaxially within the mixer drum 14, with a conveyor support assembly 60 supporting the screw conveyor 36 for longitudinal movement relative to the mixer drum 14. The conveyor support assembly 60 is comprised of a conveyor carriage 62 supporting the screw conveyor 36 adjacent to the first end 44 of the screw housing 46, the carriage 62 having a plurality of wheels 64; and a pair of parallel support members 66 mounted on opposite sides of the frame 16 which support the wheels 64 and facilitate movement of the carriage 62 and screw conveyor 36 mounted thereon horizontally relative to the mixer drum 14 to vary the position of the discharge outlet 48 of the screw conveyor 36 relative to the mixer drum 14.

In the preferred embodiment, a bearing assembly 68 is disposed circumferentially around a medial portion of the screw housing 46 to facilitate support of the screw housing 46 coaxially within the mixer drum 14 via a plurality of support members 70 (only one of which is shown in FIG. 1 for purposes of simplicity) extending radially between the bearing assembly 68 and the inner surface of the mixer drum 14. In addition, a heat shield 72 is connected to the second end 50 of the screw housing 46 to shield screw conveyor 36 and particularly the bearing 56 from the flame produced by the burner assembly 22 so as to prevent excessive heat build up in the screw conveyor 36 during the operation of the mixer 10.

To facilitate movement of the aggregate materials within the mixer drum 14, a plurality of flights 74 (only a few of which are shown for reasons of simplicity) are connected to the inner surface of the mixer drum 14 for mixing the new and recyclable aggregates with the asphaltic oil to form a hot mix asphalt. In addition, the frame 16 is provided with a plurality of support legs 76 pivotally connected thereto at spaced intervals therealong so that the mixer drum 14 may be operated with the first end 24 thereof higher than the second end 38 thereof. Thus, the hot mix asphalt will migrate under the influence of gravity toward the second end 38 of the mixer drum 14 for discharge via a discharge outlet 78 disposed adjacent the second end 38 of the mixer drum 14.

If desired, a dust collection apparatus (not shown) may be connected in a conventional manner to the upper portion of the outlet shroud assembly 40 to minimize the expulsion of pollutants into the surrounding environment. In addition, a secondary injection nozzle 80, connected to the asphalt injection apparatus 32 via a conduit 82, may be provided adjacent the second end 38 of the mixer drum 14 to inject asphaltic oil into the charging hopper 42 of the conveyor assembly 12 thereby facilitating introduction of the asphaltic oil into the drum 14 via the recyclable aggregate.

OPERATION OF THE PREFERRED EMBODIMENT

To facilitate transportion of the mixer 10 to a desired operating location, the support legs 76 should be pivoted upwardly relative to the frame 16 to a storage position as shown in FIG. 1, so that the frame 16 may assume a substantially horizontal position relative to the earth's surface 84. Thereafter, the front end 86 of the frame 16 may be connected in a conventional manner to a tractor or the like with the rear end 88 of the frame 16 being supported via the dual-tandem wheel assembly 90.

Upon arrival at the desired operating location, the mixer 10 may be placed in an operating position by raising the front end 86 of the frame 16 and pivoting the support legs 76 downwardly relative to the frame 16 into engagement with respective support blocks 92 disposed upon the earth's surface 84*a*. The new aggregate conveyor assembly 28 may then be positioned with the discharge end 94 thereof substantially vertically above the charging hopper 30 to facilitate feeding of the new aggregate into the first end 24 of the mixer drum 14. In addition, the burner assembly 22 should be connected to a suitable source of fuel (not shown) and appropriately actuated to produce a flame in the mixer drum 14 extending from the first end 24 thereof to a medial portion thereof; the asphalt injection apparatus 32 should be connected to a suitable asphaltic oil reservoir (not shown) providing heated asphaltic oil at a temperture on the order of 300° F.; and each of the chain drive assembly 20 and the screw drive assembly 58 should be connected to a suitable source of power and placed in actuated conditions to rotate the drum 14 and the screw 52, respectively, about the longitudinal axes thereof. If dust collection is desired, the outlet shroud assembly 40 should have the upper portion thereof connected in an appropriate manner to a conventional dust collection apparatus (not shown).

After the burner assembly 22 has heated the mixer drum 14 to a desired operating temperature, the new aggregate conveyor assembly 28 should be actuated to feed new aggregate into the first end 24 of the mixer drum 14, with the composition of the new aggregate being selected according to job specifications in a well known manner. Substantially simultaneously, the asphalt injection apparatus 32 should be actuated to inject the heated asphaltic oil into the mixer drum 14 with the point of injection 96 being varied until the exhaust issuing through the output shroud assembly 40 indicates an acceptable level of combustion of the oil. Thereafter, recyclable aggregate may be fed into the charging hopper 42 of the screw conveyor 36 via conventional apparatus (not shown) similar to the new aggregate conveyor assembly 28, with the rate of feeding being determined in a conventional manner from the job specifications.

As will be clear to those skilled in the art, the recyclable aggregate should preferably be heated to as high a temperature as possible to facilitate optimum interaction with the asphaltic oil, while at the same time minimumizing the amount of combustion of the asphaltic composition portion of the recyclable aggregate. Thus, the point at which the discharge outlet 48 should introduce the recyclable aggregate into the mixer drum 14 will be highly dependent upon the composition of the recyclable aggregate, the operating characteristics of the burner assembly 22, and the rate of feeding and composition of the new aggregate being fed into the first end 24 of the mixer drum 14 via the charging hopper 30.

In view of the difficulties associated with determining beforehand the appropriate positioning of the recyclable aggregate conveyor assembly 12, the mixer 10 has been provided with particularly convenient means for determining empirically the desired position during actual operation of the mixer 10. Thus, the recyclable aggregate conveyor assembly 12 should be initially positioned well forwardly on the frame 26 with the discharge outlet 48 being disposed substantially at the mid-point of the mixer drum 14. Thereafter, by monitoring the exhaust issuing from the outlet shroud assembly 40, the recyclable aggregate conveyor assembly 12 may be moved forwardly or rearwardly relative to the frame 16 to the point at which the temperature is sufficiently low to preclude combustion of significant quantities of the asphaltic composition portion of the recyclable aggregate.

Throughout the period of adjustment of the recyclable aggregate conveyor assembly 12, as well as the period of actual production ensuing thereafter, the action of the flights 74 in the mixer drum 14 upon the rotation thereof move the new aggregate and the recyclable aggregate around the mixer drum 14 to mix the new and recyclable aggregates with the asphaltic oil to form a hot mix asphalt. Since the mixer drum 14 is being rotated about its longitudinal axis with the first end 24 thereof higher than the second end 38 thereof, the hot mix asphalt will naturally migrate under the influence of gravity towards the second end 38 of the mixer drum 14 for discharge via the discharge outlet 78. Upon the expulsion thereof via the discharge outlet 78, the hot mix asphalt may be received by a conventional asphalt conveying and storing assembly (not shown) for charge loading into transport vehicles.

From the above, it can readily be seen that the mixer 10, as constructed in accordance with the preferred embodiment of the present invention, provides a convenient and effective means for utilizing recyclable aggregate in the production of hot mix asphalt. However, it must be recognized that various changes may be made in the construction and the arrangement of the parts or elements of the present invention as disclosed herein without departing from the spirit and scope of the invention as defined in the following claims.

What is claimed is:

1. Apparatus for producing hot mix asphalt utilizing new aggregate and a previously manufactured and layed asphalt mix which has been reduced to form recyclable aggregate, comprising:

a cylindrical mixer drum having a first end and a second end;

means supporting the mixer drum for rotation about the longitudinal axis thereof with the first end of the mixer drum higher than the second end of the mixer drum;

burner means at the first end of the mixer drum for producing a flame in the mixer drum extending from the first end of the mixer drum to a medial portion of the mixer drum;

recyclable aggregate conveyor means extending from the second end of the mixer drum to a medial portion of the mixer drum for feeding the recyclable aggregate into a medial portion of the mixer drum;

means for feeding the new aggregate into the first end of the mixer drum;

means for injecting asphaltic oil into the mixer drum;

flights in the mixer drum for moving the new aggregate and recyclable aggregate around the mixer drum and mixing the asphaltic oil, new aggregate and recyclable aggregate within the mixer drum to form a hot mix asphalt; and means for discharging the hot mix asphalt from the second end of the mixer drum.

2. The apparatus of claim 1 wherein the recyclable aggregate conveyor means are further characterized as a screw conveyor having a charging portion disposed adjacent to the second end of the mixer drum and a discharge portion disposed within the mixer drum at a medial portion thereof.

3. The apparatus of claim 2 wherein the recyclable aggregate conveyor means are further characterized as being movable relative to the mixer drum to vary the position of the discharge portion thereof relative to the mixer drum.

4. The apparatus of claim 1 wherein the recyclable aggregate conveyor means are further defined to include:

a screw conveyor having a charging portion disposed adjacent to the second end of the mixer drum and a discharge portion disposed within the mixer drum at a medial portion thereof; and conveyor support means supporting the screw conveyor adjacent the second end of the mixer drum for movement of the screw conveyor relative to the mixer drum to vary the position of the discharge portion of the screw conveyor relative to the drum.

5. The apparatus of claim 1 further defined to include:

heat shielding means disposed within the mixer drum for shielding the recyclable aggregate conveyor means from the flame produced by the burner means.

6. The apparatus of claim 1 wherein the means for injecting asphaltic oil are further defined to include:

a primary injection nozzle extending through the first end of the mixer drum to a medial portion of the mixer drum, the primary injection nozzle injecting asphaltic oil into the medial portion of the mixer drum.

7. The apparatus of claim 6 wherein the means for injecting asphaltic oil are further defined to include:

a secondary injection nozzle disposed adjacent the second end of the mixer drum, the secondary injection nozzle injecting asphaltic oil into the recyclable aggregate conveyor means for introduction into the mixer drum via the recyclable aggregate.

8. The apparatus of claim 1 wherein the recyclable aggregate conveyor means is further characterized as feeding the recyclable aggregate into the mixer drum at a point at which the temperature is sufficiently low to preclude combustion of significant quantities of the asphaltic composition portion of the recyclable aggregate.

9. The apparatus of claim 1 wherein the means for injecting asphaltic oil is further characterized as injecting the asphaltic oil into the mixer drum at a point at which the temperature is sufficiently low to preclude combustion of significant quantities of the asphaltic oil.

* * * * *